US006053546A

United States Patent [19]

Frolov

[11] Patent Number: 6,053,546

[45] **Date of Patent: *Apr. 25, 2000**

[54] TRIGGER SYSTEM FOR ELECTROMAGNETIC LOCK

[75] Inventor: George Frolov, Farmington, Conn.

[73] Assignee: Harrow Products, Inc., Grand Rapids, Mich.

[ * ] Notice: This patent is subject to a terminal disclaimer.

[21] Appl. No.: 09/089,572

[22] Filed: Jun. 3, 1998

[51] Int. Cl.[7] ..... E05C 17/56

[52] U.S. Cl. ..... 292/251.5; 292/144

[58] Field of Search ..... 292/251.5, 92, 292/94, DIG. 65; 70/276, 441, DIG. 49

[56] References Cited

U.S. PATENT DOCUMENTS

| | | | |
|---|---|---|---|
| 4,652,028 | 3/1987 | Logan et al. | 292/251.5 |
| 4,682,801 | 7/1987 | Cook et al. | 292/251.5 |
| 4,703,962 | 11/1987 | Kelly et al. | 292/251.5 |
| 4,720,128 | 1/1988 | Logan, Jr. et al. | 292/251.5 |
| 4,915,431 | 4/1990 | Bailey | 292/251.5 |
| 4,981,312 | 1/1991 | Frolov | 292/251.5 |
| 5,016,929 | 5/1991 | Frolov | 292/251.5 |
| 5,033,779 | 7/1991 | Geringer et al. | 292/251.5 |
| 5,065,136 | 11/1991 | Frolov et al. | 292/251.5 |
| 5,141,271 | 8/1992 | Geringer et al. | 292/251.5 |
| 5,184,855 | 2/1993 | Walt et al. | 292/251.5 |
| 5,184,856 | 2/1993 | Waltz | 292/251.5 |
| 5,376,910 | 12/1994 | Geringer et al. | 292/251.5 X |
| 5,496,079 | 3/1996 | Frolov | 292/251.5 |
| 5,611,582 | 3/1997 | Frolov et al. | 292/251.5 |
| 5,641,187 | 6/1997 | Frolov | 292/251.5 |
| 5,709,421 | 1/1998 | Gillham | 292/251.5 |
| 5,758,913 | 6/1998 | Roth et al. | 292/251.5 |
| 5,823,582 | 10/1998 | Frolov et al. | 292/251.5 |
| 5,897,149 | 4/1999 | Frolov | 292/251.5 |

*Primary Examiner*—Teri Pham
*Attorney, Agent, or Firm*—Alix, Yale & Ristas, LLP

[57] ABSTRACT

An electromagnetic lock assembly employs a switch which detects an attempt to open the door. The armature is biased tow the door by a spring acting between a mounting bolt for the armature. An actuator protrudes from the electromagnet bonding face and engages against the cap of the mounting bolt. A switch may thus be actuated while the electromagnetic bonding between the armature and the electromagnet is maintained.

20 Claims, 5 Drawing Sheets

TRIGGER SYSTEM FOR ELECTROMAGNETIC LOCK

FIELD OF THE INVENTION

This invention relates generally to door security systems. More specifically, the invention relates to electromagnetic locks which are employed for securing doors and controlling ingress and egress.

BACKGROUND OF THE INVENTION

Electromagnetic locks have enjoyed widespread usage in security applications, such as for securing a door against ingress and egress. Electromagnetic locks have proven to be reliable and versatile systems for security applications. Such locks typically allow instant ingress or egress during an emergency situation. Electromagnetic locks also readily provide a failsafe feature by unlocking in the event of a power failure.

Delayed unlocking systems have been integrated into electromagnetic locks to delay ingress or egress through a secured doorway. Electromagnetic locks employing delayed unlocking have found particular use in hospitals and nursing homes. The delayed unlocking of a secured door allows for security personnel or hospital staff to determine whether the ingress or egress is appropriate for a particular patient. Therefore, in non-emergency situations, hospitals or nursing home personnel can restrain a patient from exiting from the facility unattended.

An example of an electromagnetic lock having a delay feature is disclosed in Logan U.S. Pat. No. 4,720,128. The housing for the electromagnet is mounted to a door frame. A switch is located adjacent to the electromagnet. An armature opposite the electromagnet and a block opposite the switch are mounted to the door associated with the door frame. Actuation of the switch by the block begins a delayed egress sequence. The housing is of relatively large size due to the electromagnetic lock and the adjacent switch associated with the electromagnet. Furthermore, the switch may be exposed to tampering.

Bailey U.S. Pat. No. 4,915,431 discloses an electromagnetic lock system with a switch assembly which provides a door-movement alert for delayed egress or a security alert. This electromagnetic lock employs an armature which is floatably attached to the door by a plunger-bolt assembly fixed to the door. An electromagnet is fixed to the door frame. A door-movement alert switch comprises a pushbutton switch supported on the electromagnet and a plunger supported on the plunger-bolt assembly. A spring force-biases the plunger into mating contact with the switch when the door is electromagnetically locked to establish a first switch-actuation state. The force-biased spring maintains the switch in the first state while the armature is magnetically restrained. When the door is opened and the door-movement distance is slightly less than the armature float distance, the plunger is partially drawn into a plunger housing fixed on the plunger-bolt assembly. In this electromagnetic lock assembly, the armature is essentially not biased toward the door by a spring acting between a mounting bolt and the armature, and the switch assembly is relatively complex.

Another example of an electromagnetic lock system employing delayed unlocking is disclosed in Frolov et al U.S. Pat. No. 5,065,136, which is assigned to the assignee of the present invention. An electromagnet is mounted to a lock frame to provide a rocking movement. The lock frame is fixed to the door frame. Motion of the door while the electromagnet is electromagnetically bonded to the associated armature correspondingly pivots or rocks the entire electromagnet within the lock frame. This rocking motion actuates a switch. The switch actuation activates an alarm, begins a delay sequence for unlocking or otherwise initiates various security-related functions.

SUMMARY OF THE INVENTION

Briefly stated, the invention in a preferred form is a compact electromagnetic lock for securing a door and implementing a delayed egress function. The electromagnetic lock of the invention comprises an electromagnet lock assembly and an armature assembly and incorporates a trigger for initiating delay egress, activating an alarm or triggering other functions. A housing which mounts the electromagnet is permanently mounted to a door frame. The electromagnet defines an attractive face that is generally oriented toward the door.

The armature assembly is mounted to the door in opposing relationship to the attractive face of the electromagnet by means of an armature mount. The armature mount permits the armature assembly to undergo constrained motion relative to the door. An armature bolt having an expanded head is captured in a cavity of the armature, and the shank of the armature bolt passes through an armature opening to fixedly mount the armature to the door.

An armature bolt spring is compressed between the expanded head of the armature bolt and the armature. The armature spring provides an expansion force to maintain the armature in a relatively tight relationship against the door while still permitting the armature to undergo constrained motion relative to the door. The constrained motion of the armature relative to the door is employed to actuate a switch system to begin the delayed unlocking sequence. The switch system comprises a plunger and a control switch. The plunger extends through the attractive face of the electromagnet. The plunger actuates the control switch which is located behind the electromagnet within the housing. The plunger is centrally positioned so that when the armature electromagnetically bonds with the attractive face of the electromagnet, the plunger contacts the head or a cap of the armature mounting bolt. The plunger is biased outwardly by a spring to a normally extended position.

Pressure placed on the door by a person attempting to egress compresses the armature bolt spring and allows the door to undergo constrained motion by swinging slightly outward away from the door frame. The armature remains in full attractive electromagnetic engagement with the energized electromagnet as the door initially moves. The constrained motion of the door draws the armature bolt head away from the attractive face of the electromagnet. The motion of the armature bolt allows the plunger to move outward under the biasing force of the plunger spring. This plunger motion actuates the control switch to initiate a delayed unlocking sequence, an alarm or some other security function.

The location of the plunger extending through the attractive face of the electromagnet and the associated control switch located behind the electromagnet allows for a compact lock construction. Furthermore, the armature bolt spring biases the door in a manner that allows the force holding the door closed to be adjusted. For example, the spring rate of the armature spring can be selected to provide a pre-established threshold force to so as to not allow the switch to be triggered by small transient forces on the door.

Therefore, it is an object of the invention to provide a new and improved electromagnetic lock that is responsive to movement of a door while maintaining a bond of high integrity.

Another object of the invention is to provide an electromagnetic lock that is compact in size yet capable of reliably sensing door movement.

A further object of the invention is to provide an electromagnetic lock for securing a door that efficiently and effectively initiates a delayed unlocking sequence when an individual attempts to open the secured door.

A yet further object of the invention is to provide an electromagnetic lock wherein the magnitude of the force required to initiate opening of the lock can be efficiently and properly adjusted.

These and other objects of the invention will be apparent from the specification and drawings.

DETAILED DESCRIPTION OF THE PREFERRED EMBODIMENT

Figure 1:
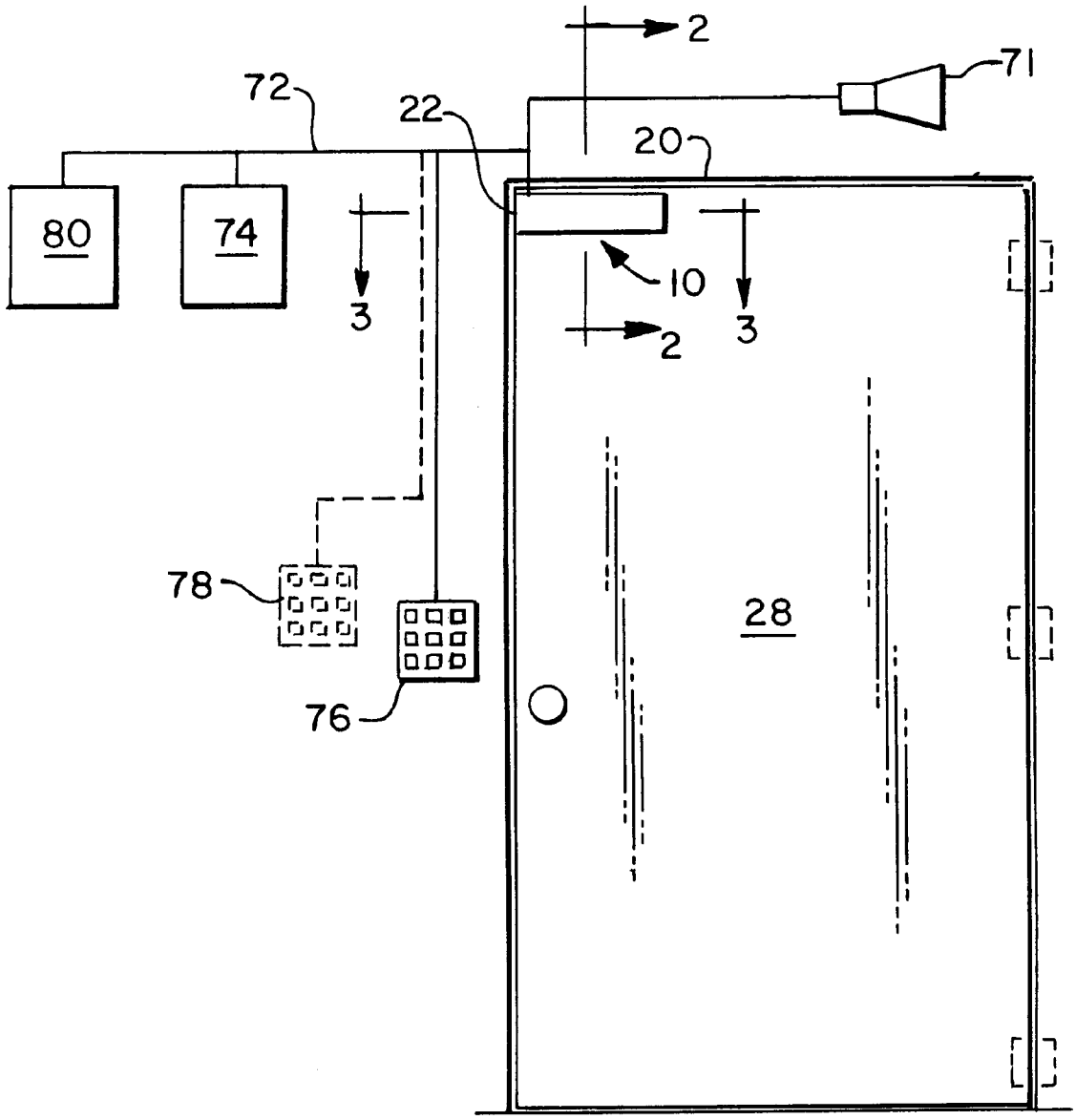
FIG. 1 is a frontal view, partially in phantom, of the electromagnetic lock of the invention with an associated door and door frame.

With reference to the drawings, wherein like numerals represent like components or assemblies throughout the drawings, a lock system in accordance with the invention is designated generally by the numeral 10. The lock system 10 secures a door 28 against a door frame 20. The lock system 10 comprises an electromagnetic lock assembly 12 and an armature assembly 14. The electromagnetic lock assembly 12 is preferably located at an upper corner of the door frame 20 so as to present minimal obstruction to persons and equipment passing through the doorway.

The electromagnetic lock assembly 12 comprises a lock housing 16. The lock assembly 12 is rigidly fixed to the door frame 20 by a lock mounting plate 22. (See FIG. 1.) The plate 22 is fixed to the door frame 20 by screws 24 extending through the plate 22 and into the door frame 20. Housing end plates 18 at the ends of the lock housing 16 are secured by machine screws. Mounting bolts 26 extend through the housing end plates 18 and into the lock mounting plate 22 to securely mount the housing 16 to the door frame 20.

The electromagnet 30 is constructed of a series of stacked E-shaped laminations 32. An electromagnet coil 34 is positioned inside the spaces defined by the E-shaped laminations 32. The coil is supported in the spaces by a potting material, or the coil can be wound around a bobbin, with the bobbin held by frictional engagement with the legs of the laminations 32. The end edges of the legs of the E-shaped laminations 32 define an electromagnetic attractive face 36 on the front of the lock assembly 12. The defined attractive face 36 is oriented toward the door 28.

The armature assembly 14 is mounted to the door opposite the lock assembly 12. The armature assembly 14 comprises an armature 38 and an armature mount. The armature 38 is constructed of a ferromagnetic material such as soft iron for strong electromagnetic engagement with the attractive face 36 of the electromagnetic 30 when the electromagnet 30 is energized. An armature backing plate 40 is affixed to the back of the armature 38 by machine screws. The armature 38 and the armature backing plate 40 define an armature cavity 42 of generally cylindrical shape therebetween. The armature backing plate 40 further defines a coaxial bolt opening 43 contiguous with the armature cavity 42. The bolt opening 43 has a smaller diameter than the corresponding diameter of the armature cavity 42.

An armature bolt 44 is captured within the armature cavity 42. The armature bolt 44 has a slotted head 46 and a threaded shank 48. The slotted head 46 is positioned in the armature cavity, and the shank portion 48 extends through the bolt opening 43 and into the door 28. A blind nut 50 passes through a bore in the door 28 and threadably engages with the threaded shank 48 of the armature bolt 44 to hold the armature bolt 44 in a fixed relation to the door 28.

An armature washer 52 is positioned underneath the slotted head 46 and around the shank 48 of the armature bolt 44. The diameter of the armature washer 52 is larger than the diameter of the bolt opening 43 in the armature backing plate 40 through which the armature bolt 44 passes so that the slotted head portion 46 of the armature bolt 44 is captured within the armature cavity 42. The bolt opening 43 in the armature backing plate 40 is sufficiently large, however, having a diameter greater than that of the bolt shank 48 to allow the armature 38 and the armature backing plate 40 to rock on the armature bolt 44 with a constrained motion.

Figure 3:
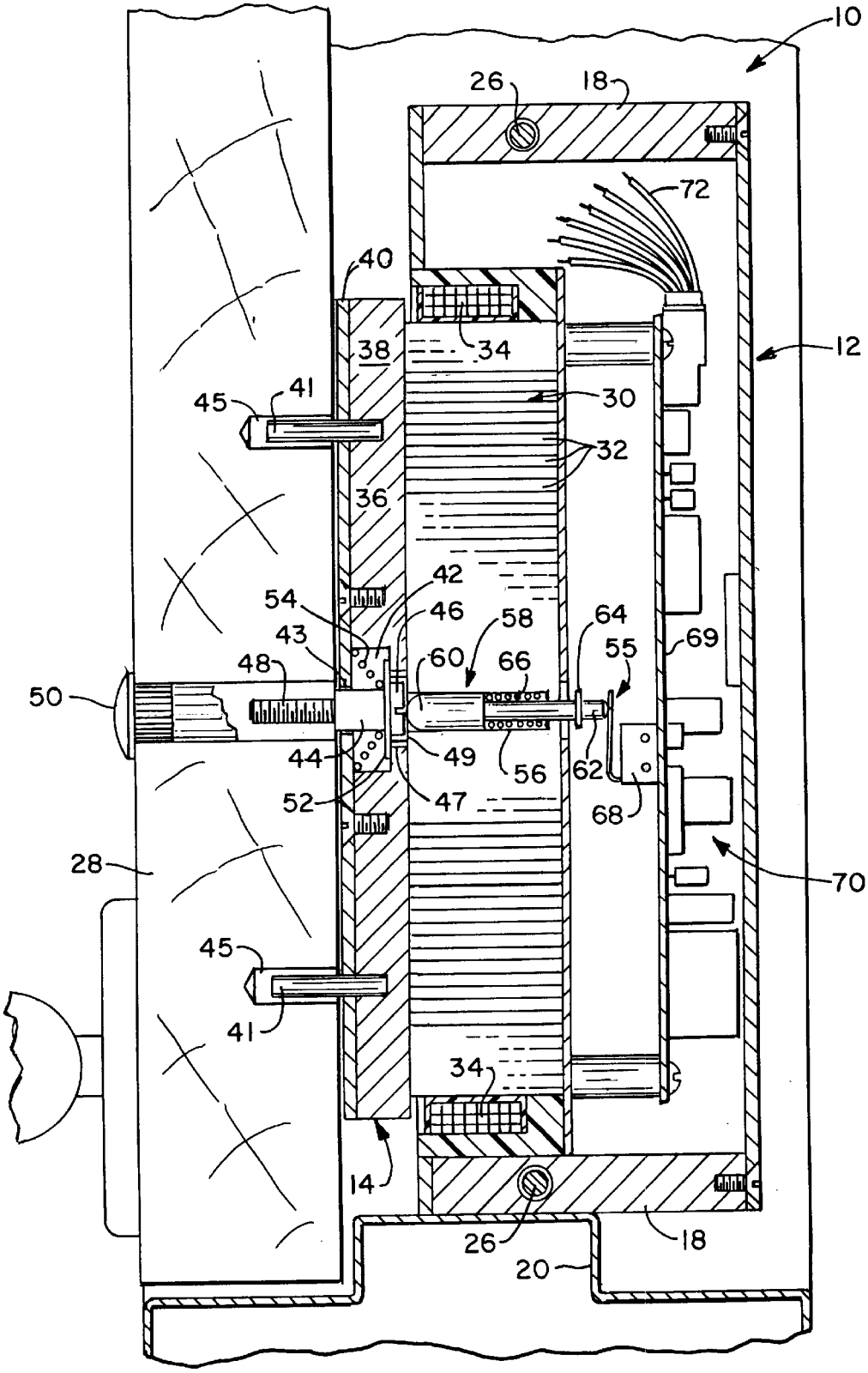
FIG. 3 is an enlarged fragmentary sectional view, partially broken away, of the electromagnetic lock, door and frame of FIG. 1 taken along the line 3—3.
Figure 4:
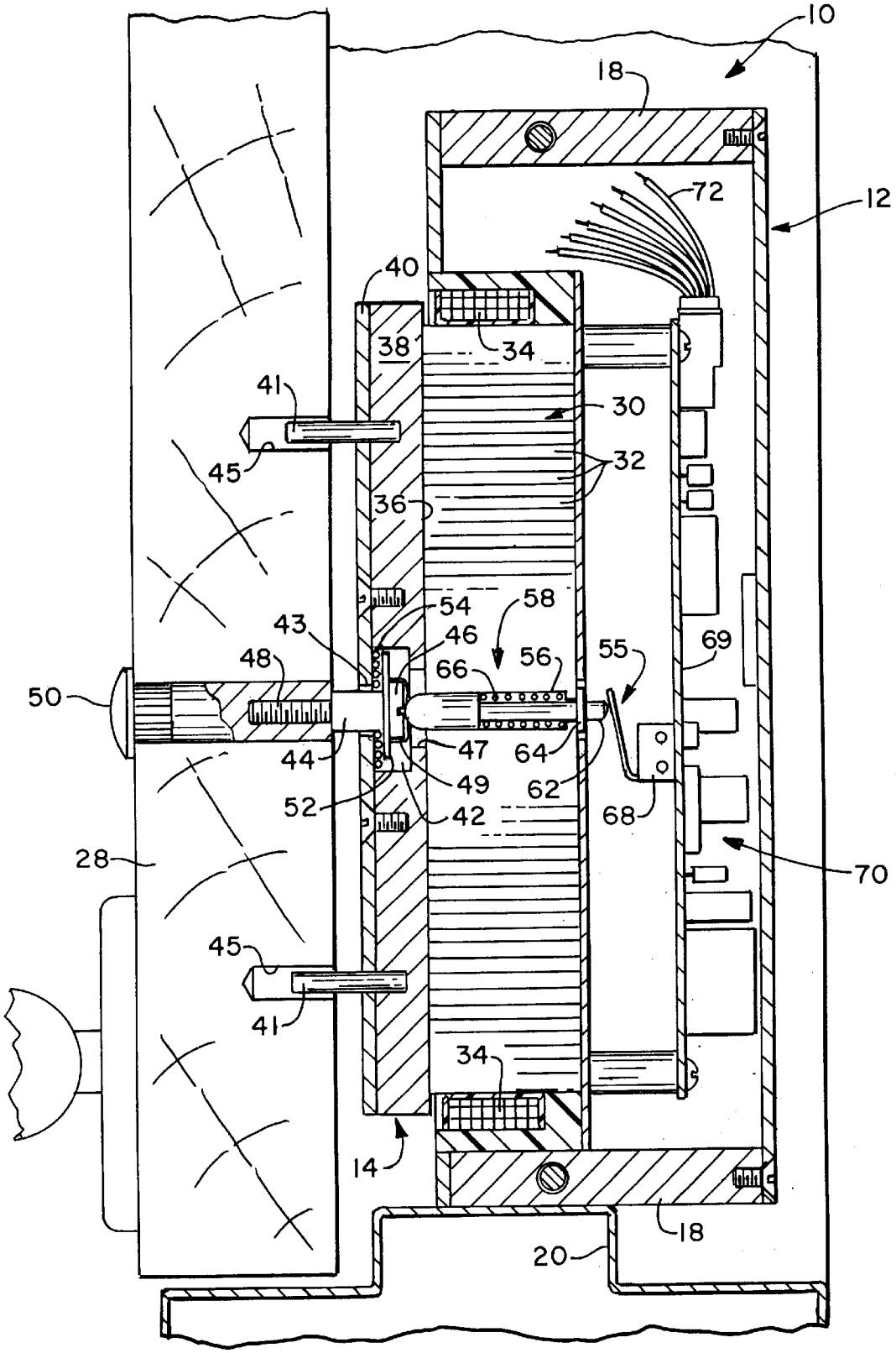
FIG. 4 is an enlarged fragmentary sectional view, partially broken away, of the electromagnetic lock, door and frame of FIG. 1 taken along the line 3—3, with the door forced slightly away from the door frame.

To maintain alignment of the armature 38 on the door 28, armature pins 41 mounted to the armature 38 extend into armature pin bores 45 in the door 28. The pins 41 maintain alignment of the armature 37 relative to the door 28 when the armature 38 floats. The floating motion is illustrated by comparing the armature positions of FIGS. 3 and 4. An opening 47 is also provided through the armature to in part allow access to the slotted head of the armature bolt. (See FIG. 4.) A cap 49 may be snapped in place to cover the head 46.

The constrained motion of the armature assembly 14 serves at least two purposes. First, the constrained motion of the armature assembly 14 allows the armature 38 to fully engage in surface to surface contact with the attractive face 36 of the electromagnet 30 to enhance the bonding qualities of the lock. The limited floating relationship compensates for small discrepancies in position and angle between the armature system 14 and the lock system 12. Naturally, the absence of gaps between the armature 38 and electromagnet 30 facilitates a strong electromagnetic bond between the components and therefore a strong locking force.

Figure 2:
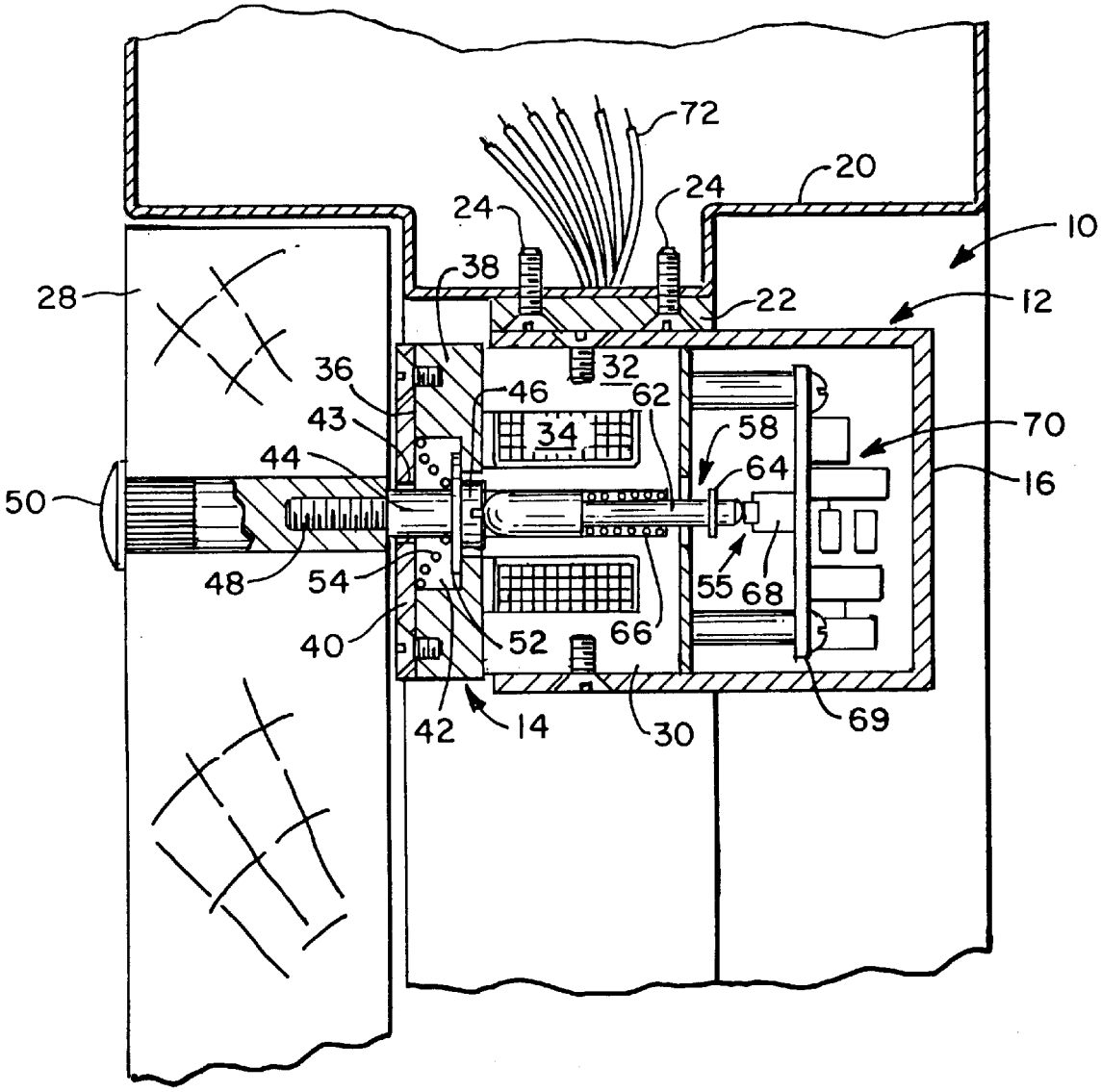
FIG. 2 is an enlarged fragmentary cross-sectional view, partially broken away, of the electromagnetic lock, door and frame of FIG. 1 taken along the line 2—2.

The constrained movement feature of the armature assembly 14 also accommodates small constrained movement of the door 28 when the armature system and lock system 12 are engaged. This small constrained movement of the door functions as an activating force for triggering a switch mechanism 55. The constrained movement is permitted by the captured armature bolt and an armature spring 54. The armature spring 54 is preferably a conical coil spring which assumes a substantially flat configuration in the fully compressed state. The armature spring 54 is positioned between and exerts an expansion force on the armature washer 52 and the armature backing plate 40. The axial position of the washer 52 is limited by the fixed position of the bolt head 46 in relation to the door and, in the locked configuration of FIG. 2, by the annular wall of the armature cavity 42. The armature spring 54 thus serves to hold the armature 38 in relatively tight engagement with the door 28. When the armature system 14 is electromagnetically bonded to the electromagnet 30, the armature spring 54 biases the door 28 to the fully closed position. (See FIG. 3.) However, when a force is placed upon the door 28 to open the door 28, the armature spring 54 compresses, allowing the door to swing very slightly in an opening direction. (See FIG. 4.) The door 28 remains locked however, even when slightly displaced, due to the armature being in continuous and substantially full surface-to-surface engagement with the electromagnet 30.

By selecting an appropriate pre-established spring force for the armature spring 54, the magnitude of force necessary to overcome the force of the spring and displace the door can be regulated. For example, on doors leading to the exterior of a building, the armature spring 54 may have a higher spring rate to avoid actuating the lock during certain exterior environmental conditions such as wind conditions. Secured interior doors, which are not subject to intense transient environmental forces, may employ springs with lower spring rates so as to allow for easier door opening. Furthermore, the spring rate of the armature spring 54 can be selected to compensate for doors of different masses, or for an atypical lock location on a particular door.

The constrained motion of the armature relative to the door is employed to trigger the switch mechanism 55. When the armature spring 54 compresses due to a person attempting to use the door 28, the small motion of the door 28 may actuate the switch mechanism 55 to activate an alarm, begin a delay sequence, or initiate some other security or emergency function, as described below.

Figure 5:
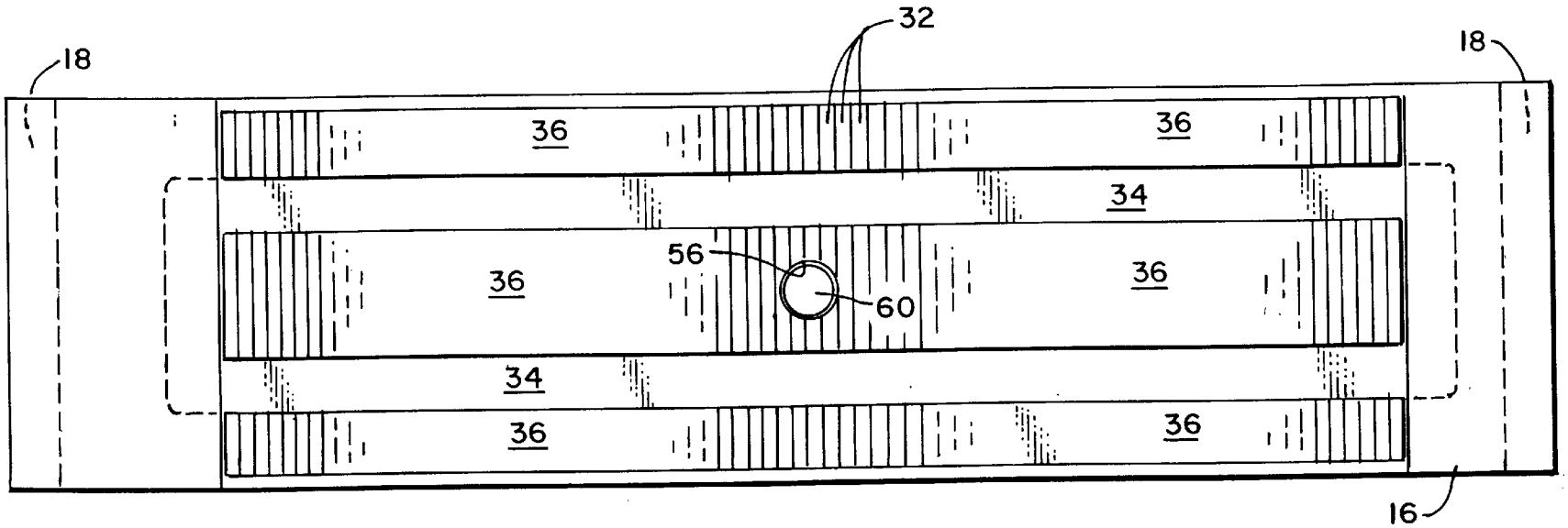
FIG. 5 is a frontal elevational view, partly in phantom, of the attractive face of the electromagnetic lock of FIG. 1.

The switch mechanism 55, which preferably functions in a bistable mode, comprises a plunger assembly 58 and a control switch 68. The switch plunger assembly 58 is supported by the walls of a switch plunger passage 56. The switch plunger passage 56 extends through the center of the electromagnet 30. (See FIG. 5.) The plunger assembly 58 has a plunger head 60 dimensioned and positioned to extend through the opening 47 in the armature and to contact the slotted head 46 or cap 49 of the armature bolt 44. A plunger rod 62 fixed to the plunger head 60 extends through the plunger passage 56 and terminates beyond the back of the electromagnet 30. A plunger spring 66 biases the plunger 58 to protrude in front of the attractive face 36 of the electromagnet 30 and toward the armature system 14. The spring force of plunger spring 66 is much less than that of armature spring 54. The plunger spring 66 is confined by the wall of the plunger passage 56 and biases against the plunger head 60. A plunger stop 64 is fixed to the plunger rod 62 behind the electromagnet 30. The plunger stop 64 limits the distance the plunger head 60 extends in front of the attractive face 36 of the electromagnet 30 when the armature 38 is swung away from the lock assembly 12. The end of the plunger rod 62 opposite the head contacts the arm of the control switch 68. The control switch 68 is preferably a microswitch for compactness.

The location of the switch mechanism 55 in a central position relative to the electromagnet attractive face provides a compact and efficient configuration for the lock unit. The control switch 68 is mounted to a circuit board 69 which mounts the other electrical and electronic components of the lock assembly 12. Furthermore, when the armature assembly 14 is electromagnetically bonded to the lock assembly 12, the switch mechanism 55 is well protected.

During operation of the electromagnetic lock system 10 of the invention, the door 28 is held in a normally closed position with the armature system 14 electromagnetically bonded to the electromagnet 30. (See FIG. 3.) The switch plunger assembly 58 is retracted into the plunger passage, and the plunger head 60 contacts the slotted head portion 46 of the armature bolt 44 or a cap 49 mounted to the head portion 46.

When a person attempts to pass through the doorway, the person pushes or pulls on the door 28 depending on whether the person is attempting to egress or ingress. Due to the constrained motion permitted by the armature system 14, the door can swing slightly outward away from the door frame (in the direction of the FIG. 4 arrow), therefore compressing the armature spring 54 between the armature bolt washer 52 on the armature bolt 44 and the armature back plate 40. (See FIG. 4.) The door 28 is restricted from any further outward displacement due to the armature bolt 44 being captured within the armature cavity 42, and the armature 38 being bonded to the electromagnet 30. The constrained or limited displacement of the door 28 is sufficient to move the armature bolt 44 outward away from the attractive face 36 of the electromagnet 30. The plunger assembly, in contact with the cap 49 through the armature bolt, then also moves outward due to the biasing force of the plunger spring 66. The displacement of the switch plunger assembly 58 displaces the end of the plunger rod 62 from the control switch 68. The control switch 68 thus changes from a first state (FIG. 3) to a second state (FIG. 4) to effectively generate a signal.

The signal generated by the control switch 68 is transmitted to a lock control system 70. The lock control system 70 controls the energizing and deenergizing of the electromagnet 30. In the preferred embodiment of the lock system 10, the lock control system 70, on reception of the signal from the control switch 68, initiates an alarm and begins a delayed unlocking sequence. After the lock control system 70 has counted down for the pre-established delay time, the lock control system 70 deenergizes the electromagnet 30. This deenergizing of the electromagnet 30 releases the armature system 14 from the electromagnet 30, and thereby allows the door 28 to swing to a fully open position.

The actuation of switch 68 may be employed to accomplish a wide spectrum of functions. In one embodiment of the invention, an attempt to use the door 28 secured by the lock system 10 activates an audible and/or visual alarm 71 at the site of the doorway. The lock control system 70 may also transmit an alarm signal over multi-strand lines 72 to a remote security control panel 74. Either the local or remote alarms could be combined with the delayed egress sequence to allow security or hospital personnel sufficient time to travel to the site of the doorway. Furthermore, the lock system 10 can be efficiently integrated into a fire and security system to provide immediate ingress or egress in an emergency situation.

The door security system provided by the invention may further comprise a card reader, key pad, contact activatable electronic key or other form of personal identification reader. With reference to FIG. 1, a personal identification reader such as a key pad 76 can be located on the first side of the door 28. The keypad 76 communicates with the lock control system 70 and/or the remote security control panel 74. Entry of a valid code into the key pad 76 allows an immediate egress and does not activate an alarm. A second reader 78 which also communicates with the lock control system 70 and/or the remote security control panel 74 can be provided on the second side of the door for immediate ingress without an alarm. The programming for such systems is well known and U.S. Pat. No. 5,065,136 Frolov et al is incorporated by reference as an example of such a system. The lock control system 70, readers 76, 78 and remote security panel 74 communicate over the multi-strand lines 72. Furthermore, the lock system 10 may be powered by a power supply 80 over the lines 72.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A lock system for securing a door, said lock system comprising:

a lock housing adapted for mounting to a door frame;

an electromagnet fixed to said housing, said electromagnet defining an electromagnetic attractive face;

an armature for electromagnetic engagement with said attractive face;

an armature mounting assembly for mounting said armature to a door, said armature mounting assembly comprising a spring for biasing said armature toward said door and allowing constrained movement of said armature relative to said door while said armature is in electromagnetic engagement with said attractive face; and a switch comprising an actuator extending through said attractive face, said switch having a first state and a second state, said switch being transformable between said states when said door moves while said armature is engaged to said attractive face.

2. The lock system of claim 1 wherein said electromagnet has a front side defined by said attractive face and an opposite rear side and wherein said actuator comprises a plunger extendable in front of said attractive face of said electromagnet and a switch located rearwardly from said rear side of the electromagnet.

3. The lock system of claim 1 further comprising delay means connected to said switch for delaying unlocking of said lock system for a pre-established delay time after said switch transforms between said states.

4. The lock system of claim 3 further comprising alarm means and wherein said switch activates said alarm means when said switch transforms between said states.

5. The lock system of claim 1 further comprising alarm means and wherein said switch activates said alarm means when said switch transforms between said states.

6. The lock system of claim 1 wherein said armature defines a cavity, and said armature mounting assembly comprises an armature bolt having a first end at least partially captured in said cavity, a second end adapted for mounting to a door, and said spring biases between said bolt and said armature.

7. The lock system of claim 6 wherein said bolt has a cap and said actuator contacts said armature bolt cap.

8. The lock system of claim 7 wherein said actuator comprises a spring loaded plunger having first and second ends, said first end contacts said armature bolt cap, and said second end contacts said switch.

9. A lock system for securing a door mounted to a door frame, said lock system comprising:

a housing;

an electromagnet mounted to said housing, said electromagnet defining an electromagnetic attractive face;

switch means comprising actuator means extending through said attractive face, said switch means having a first state and a second state, said switch means generating a signal when said switch means changes between said first and said second states;

first spring means for biasing said switch means to said second state;

armature means for electromagnetic bonding against said attractive face of said electromagnet; and armature mounting means for mounting said armature means to said door, said armature mounting means comprising a second spring means for biasing said armature means against said door and allowing constrained motion of said armature means away from said door.

10. The lock system of claim 9 wherein said first spring means comprises a first spring having a first spring force and said second spring comprises a second spring having a second spring force, said second spring force being greater than said first spring force.

11. The lock system of claim 10 further comprising delay means for delaying unlocking of said lock system for a pre-established delay time after said switch means generates said signal.

12. The lock system of claim 9 wherein said electromagnet has a front side defined by said attractive face and an opposite rear side and wherein said actuator means comprises a plunger extendable in front of said attractive face of said electromagnet and a switch located rearwardly from said rear side of the electromagnet.

13. The entry system of claim 9 wherein said armature means defines a cavity and said armature mounting means comprises an armature bolt having a first end at least partially captured in said cavity and said second spring means biases between said bolt and said armature means.

14. The lock system of claim 9 wherein said actuator means is displaceable generally transversely to said face.

15. The lock system of claim 9 wherein said actuator means is generally centrally located relative to said face.

16. A controlled entry system comprising:

a door frame and door mounted to said frame;

an electromagnet assembly fixedly mounted to said door frame, said electromagnet assembly comprising:

an electromagnet defining an electromagnetic attractive face;

a switch assembly comprising an actuator projectable through said attractive face, said switch assembly having a first state and a second state, said switch assembly generating a signal when said switch assembly changes between said first and said second states;

a first spring biasing said switch assembly to said second state wherein said actuator protrudes away from said face toward said door;

an armature for electromagnetic bonding against said attractive face of said electromagnet; and an armature mounting assembly for mounting said armature to said door, said armature mounting assembly comprising a second spring biasing said armature against said door and allowing constrained motion of said armature away from said door.

17. The lock system of claim 16 wherein said electromagnet has a front side defined by said attractive face and an opposite rear side and wherein said actuator comprises a plunger extendable in front of said attractive face of said electromagnet and a switch located rearwardly from said rear side of the electromagnet.

18. The lock system of claim 17 wherein said switch is a microswitch having an actuator arm and said plunger engages said actuator arm.

19. The entry system of claim 16 wherein said armature defines a cavity and said armature mounting assembly comprises an armature bolt having a first end at least partially captured in said cavity and said second spring biases between said bolt and said armature.

20. The entry system of claim 19 wherein said second spring is a conical spring having a spring force greater than the spring force of said first spring and said bolt has a cap, said actuator engageable against said cap.

* * * * *